US006311031B1

(12) United States Patent
Hirano

(10) Patent No.: US 6,311,031 B1
(45) Date of Patent: Oct. 30, 2001

(54) TRANSFERRING DEVICE AND IMAGE FORMING APPARATUS EQUIPPED WITH MULT-MODE CLEANING ARRANGEMENT

(75) Inventor: Kouji Hirano, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/507,901

(22) Filed: Feb. 22, 2000

(30) Foreign Application Priority Data

Mar. 24, 1999 (JP) ..... P11-079901

(51) Int. Cl.[7] ..... G03G 15/16
(52) U.S. Cl. ..... 399/101; 399/99
(58) Field of Search ..... 399/98, 99, 101, 399/55, 66, 297, 310, 312, 314, 316, 345, 349

(56) References Cited

U.S. PATENT DOCUMENTS

| | | | | |
|---|---|---|---|---|
| 3,918,808 | | 11/1975 | Narita . | |
| 5,107,303 | * | 4/1992 | Miyamoto et al. | 399/349 |
| 5,111,251 | | 5/1992 | Uno et al. . | |
| 5,126,798 | | 6/1992 | Leroy et al. . | |
| 5,493,383 | * | 2/1996 | Pozniakas et al. | 399/345 |
| 5,617,195 | | 4/1997 | Torimaru et al. | 399/27 |
| 5,669,055 | * | 9/1997 | Thayer et al. | 399/349 X |
| 5,678,134 | * | 10/1997 | Miki et al. | 399/349 X |
| 5,845,174 | * | 12/1998 | Yasui et al. | 399/101 |
| 6,029,033 | * | 2/2000 | Kawasaki | 399/101 X |

FOREIGN PATENT DOCUMENTS

| | | |
|---|---|---|
| 63-44679 | 2/1988 | (JP) . |
| 5-88590 | 4/1993 | (JP) . |
| 5-289578 | 11/1993 | (JP) . |
| 5-307344 | 11/1993 | (JP) . |
| 2543048 | 7/1996 | (JP) . |

* cited by examiner

*Primary Examiner*—Sandra Brase
(74) *Attorney, Agent, or Firm*—Foley & Lardner

(57) ABSTRACT

A transferring device of the present invention includes a transferring belt configured to electrostatically adsorb an image receiving medium and convey the image receiving medium in one direction, a transferring device for transferring a toner image on a photosensitive body onto the image receiving medium adsorbed electrostatically to the transferring belt, a cleaning blade arranged so as to be able to contact/separate with/from the transferring belt and clean toner on the transferring belt when brought in contact with the transferring belt, and a cleaning brush arranged so as ato be able to contact/separate with/from the transferring belt at the downstream side in the conveying direction lower than the cleaning blade and clean the toner on the transferring belt when brought in contact with the transferring belt. The transferring device further includes a control unit to control a switching between a first mode to bring the cleaning blade contact with the transferring belt at the time of starting to use and a second mode to separate the cleaning blade from the transferring belt and bring a cleaning brush in contact with the transferring belt when the running distance of the transferring belt reaches a prescribed value.

9 Claims, 11 Drawing Sheets

| | | | CONTINUOUS PAPER SUPPLY | INTERMITTENT PAPER SUPPLY |
|---|---|---|---|---|
| TRANSFERRING BELT | SURFACE ROUGHNESS (Rz) | MAX.VALUE | 3.5 μm | 6.0 μm |
| | | MIN.VALUE | 3.0 μm | 3.0 μm |
| BLADE | EDGE CHIP | REAR | ○ | ○ |
| | | CENTER | ○ | × |
| | | FRONT | ○ | △ |

| | NUMBER OF STARTS | NUMBER OF STOPS |
|---|---|---|
| CONTINUOUS PAPER SUPPLY | 1 | 1 |
| INTERMITTENT PAPER SUPPLY | 20 | 20 |
| DIFFERENCE | 19 | 19 |

| | NUMBER OF SHEETS SUPPLIED | | | | | | |
|---|---|---|---|---|---|---|---|
| | 0 | 50,000 | 100,000 | 150,000 | 200,000 | 250,000 | 300,000 |
| 2 STAGE BRUSH CLEANER | ○ | ○ | ○ | ○ | ○ | △ | ×× |
| BRUSH + BLADE CLEANER | ○ | ○ | ○ | ○ | ○ | △ | × |

○ : NO BACK STAIN GENERATED

△ : SOME BACK STAIN GENERATED (WITHIN SPEC.)

× : BACK STAIN GENERATED (OUTSIDE SPEC.)

×× : BACK STAIN WORSENED

FIG.10

| LARGE CLASS. | SHALL CLASS. | BELT RUNNING DISTANCE (m) | SUPPLY TONER AMOUNT (g/SHEET) | SUPPLY BIAS (V) | REMARKS |
|---|---|---|---|---|---|
| BLADE A | ① | 10,500 | 0 | -400 | SUPPLY BIAS OFF |
| | ② | 21,000 | 125 | -460 | |
| | ③ | 31,500 | 250 | -520 | |
| | ④ | 42,000 | 500 | -560 | |
| BLADE B | — | 42,000 ~ 96,000 | 0 ⇩ | -400 ⇩ | SUPPLY BIAS OFF LIFE END |

FIG.11

TRANSFERRING DEVICE AND IMAGE FORMING APPARATUS EQUIPPED WITH MULT-MODE CLEANING ARRANGEMENT

BACKGROUND OF THE INVENTION

1. Field of the Invention

The present invention relates to an image forming apparatus and, more particularly, to cleaners of a transferring device to transfer a toner image formed on a photosensitive drum onto a sheet of paper conveyed by adsorbing it to a transferring belt which also functions as a conveying means.

2. Description of the Related Art

In recent years, remarkable progress is observed in the digitization of electro-photographic apparatus and digital data used copiers using digital data comprising images have been widely used. So-called reversal developing system is mainly used for digital copiers and in the transferring process, polarity of a photosensitive drum and that of a transferring member such as a transferring corona are set so that they become different each other.

Accordingly, polarity of a sheet of paper as an image receiving medium and that of a photosensitive drum are reversed and attracted to each other and a paper is adsorbed to the photosensitive drum. So, it becomes necessary to devise a means to separate a sheet of paper from the photosensitive drum.

In conventional laser printers so far available, the process speed of many of them is slow and a small diameter is sufficient for a photosensitive drum and a paper can be separated by its stiffness and further, if necessary, a separation charger is provided as an auxiliary means at the downstream side of a transfer corona, and a paper is discharged to a degree not to disturb a toner image transferred on a sheet of paper.

However, digital copiers have fast process speed and it is required to make the diameter of photosensitive drums large. Therefore, separation of paper by its stiffness becomes difficult.

So, a system has been proposed to transfer a toner image on a photosensitive drum onto a sheet of paper using a transferring belt as a transferring member while conveying the paper by adsorbing it to the transferring belt.

However, when the transferring belt is used as a transferring member, a non-image area of a photosensitive drum contacts directly the transferring belt and after generating a so-called jam, the photosensitive drum having a toner image may contact directly the transferring belt. Because of this, it is indispensable to install a belt cleaner to clean the transferring belt.

As a belt cleaner, a blade cleaner using a blade formed with a rubber elastic body is used in many cases from cost and easiness of construction. As a demerit of a blade cleaner, it can be pointed out that the coating layer of the surface of the transferring belt may be injured as stress applied to the transferring belt is relatively large.

When the coating layer of the transferring belt is injured, the blade edge is damaged and the defecting cleaning is generated. Because of this, it is necessary to mount a lubricant applying mechanism separately to obtain a stabilized cleaning performance in the use for a long period.

From such a problem, many brush cleaners using a conductive brush are proposed as a cleaning member. However, for instance, for removing a large amount of toner after generating jam, a relatively long warm-up time is needed and in addition, there will be generated a problem that it becomes very difficult to remove toner entered into a conductive brush. Therefore, in the use for a long period, there is generated a problem that the back side of a paper is stained by a toner discharged from a conductive brush.

SUMMARY OF THE INVENTION

An object of the present invention is to provide a transferring device equipped with cleaners capable of maintaining reliability in the use for a long period and cleaning a transferring belt stably and an image forming apparatus equipped with this transferring device.

According to the present invention, there is provided a transferring device comprising transferring means for transferring a toner image on a photosensitive body onto an image receiving medium adsorbed electrostatically to a transferring belt and conveyed by the transferring belt; a first cleaning means arranged so as to be able to contact/separate with/from the transferring belt for cleaning toner on the transferring belt when brought in contact with the transferring belt; a second cleaning means arranged so as to be able to contact/separate with/from the transferring belt at the downstream side in the conveying direction lower than the first cleaning means for cleaning the toner on the transferring belt when brought in contact with the transferring belt; and control means for controlling a switching between a first mode to bring the first cleaning means in contact with the transferring belt at the initial stage when starting to use and a second mode to separate the first cleaning means from the transferring belt and bring the second cleaning means in contact with the transferring belt when the running distance of the transferring belt reaches a prescribed value.

Further, according to the present invention, there is provided an image forming apparatus comprising developing means for developing an electrostatic latent image formed on a photosensitive body by supplying toner; a transferring belt configured to electrostatically adsorb an image receiving medium and convey the image receiving medium in one direction; transferring means for transferring a toner image on the photosensitive body developed by the developing means onto the image receiving medium electrostatically adsorbed to the transferring belt; a cleaning blade arranged so as to be able to contact/separate with/from the transferring belt and clean toner on the transferring belt when brought in contact with the transferring belt; a cleaning brush arranged so as to be able to contact/separate with/from the transferring belt at the downstream side in the conveying direction lower than the cleaning blade; and control means for controlling a switching between a first mode to bring the cleaning blade in contact with the transferring belt at the initial stage when starting to use and a second mode to separate the cleaning blade from the transferring belt and bring the cleaning brush in contact with the transferring belt when the running distance of the transferring belt reaches a prescribed value.

BRIEF DESCRIPTION OF THE DRAWINGS

FIG. 10 is a table showing the state of generation of stain on the reverse side;

FIG. 11 is a table showing classifications of cleaning system and developing bias control;

DETAILED DESCRIPTION OF THE PREFERRED EMBODIMENTS

Hereinafter, preferred embodiments of a transferring device of the present invention and an image forming apparatus equipped with this transferring device will be explained referring to accompanying drawings.

Figure 1:
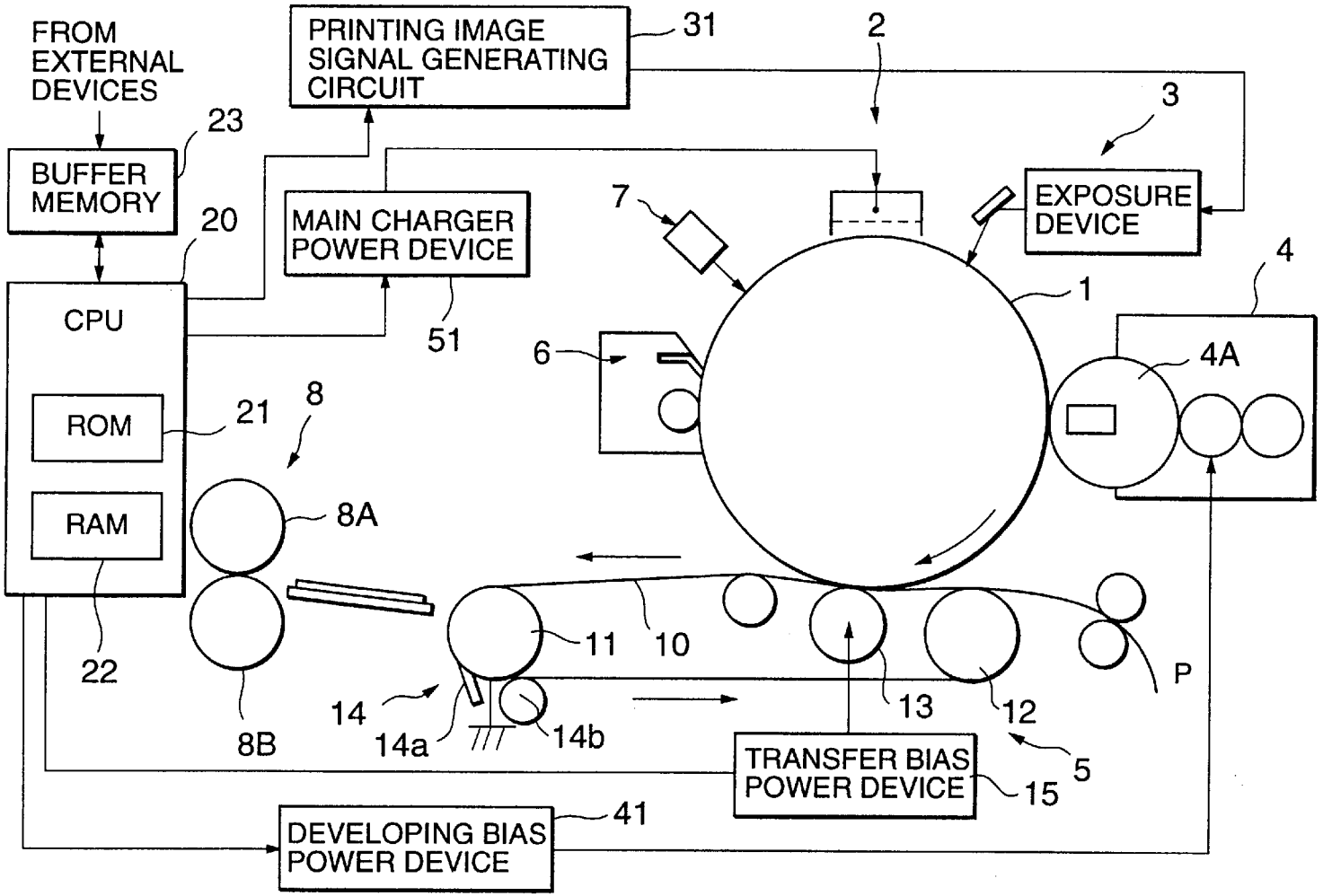
FIG. 1 is a schematic diagram showing the structures of an image forming apparatus of the present invention and a transferring device that is applied to this image forming apparatus.

As shown in FIG. 1, an image forming apparatus equipped, for instance, a printer, is equipped with a belt type transferring device for transferring a toner image formed on a photosensitive drum onto a sheet of paper as an image receiving medium conveyed in the state adsorbed to a transferring belt that also functions as a conveying means. Number of printing sheets is 60 ppm, process speed is 400 mm/sec.

A printer device is equipped with a photosensitive drum 1 as an image carrier that is rotatable in the arrow direction shown in FIG. 1. This photosensitive drum 1 is in the outer diameter 100 mm and capable of coping with a high process speed.

Around this photosensitive drum 1, a main charger 2 to charge the surface of the photosensitive drum 1 to a prescribed potential and an exposure device 3 to form an electrostatic latent image on the photosensitive drum 1 arranged at the downstream side in the rotary direction of the main charger 2 are arranged in order along the rotating direction of the photosensitive drum 1.

At the downstream side of the exposure device 3, there is arranged a developing device 4 that functions as a developing means to develop and visualize an electrostatic latent image by toner. Further, at the downstream side of this developing device 4, there is arranged a transferring device 5 that functions as a transferring means to transfer a visualized toner image on a sheet of paper that is an image receiving medium.

At the downstream side of the transferring device 5, a photosensitive drum cleaner 6 is arrange to remove residual toner left on the photosensitive drum 1 and further, at the downstream side of the photosensitive drum cleaner 6, a charge eliminator 7 is arranged to remove residual potential left on the surface of the photosensitive drum 1.

This printer is equipped with a CPU 20 that functions as a control means, a ROM 21 that stores such preset data as control data of the main body of the apparatus and control data of the developing device 4 and the transferring device 5, which will be described later, a RAM 22 to temporarily store printing data for the prescribed image processing, and a buffer memory 23 to temporarily store printing data from external devices.

Further, the printer is equipped with a printing image signal generating circuit 31 to generate a printing image signal based on the printing data stored in the RAM 22, a main charger power device 51 that controls charging voltage of the main charger 2 based on the control data stored in the ROM 21, a developing bias power device 41 that functions as a developing bias applying means to control developing bias of the developing device 4 based on the control data stored in the ROM 21, and a transfer bias power device 15 that controls transferring bias of the transferring device 5 based on the control data stored in the ROM 21.

The transferring device 5 comprises a transferring belt 10 made of a conductive elastic material, a power applying roller 13 to press the transferring belt 10 against the photosensitive drum 1 at a prescribed pressure and is applied with prescribed transferring bias output from the transferring bias power device 15, a drive roller 11 that is driven by a driver (not shown) and rotates the transferring belt 10 at a prescribed speed, a driven roller 12 that maintains the transferring belt 10 at a prescribed tension between the drive roller 11 with the power applying roller 13 put between, a belt cleaner 14 provided kept in contact with the drive roller 11 in order to recover toner, paper dust of an image receiving medium, etc. adhered on the surface of the transferring belt 10, and a guide member (not shown) that brings the transferring device 5 in contact with/separates it from the photosensitive drum 1 by a solenoid (not shown).

The transferring device 5 transfers a toner image formed on the photosensitive layer on the outer circumference of photosensitive drum 1 on an image receiving medium (not shown) by attracting the toner image thereto when prescribed transferring bias current is supplied by the transfer bias power device 15 that is explained below in the state wherein an image receiving medium is supplied between the transferring device 5 and the photosensitive drum 1.

Transfer bias is selectable on occasion according to constant voltage/current system, transferring belt 10, resistance of the power applying roller 13, process speed, etc. In this embodiment, the constant current system is used and applying current is 50 $\mu$A. The transferring belt 10 is formed with a belt-shaped material formed in a prescribed thickness from an elastic conductive matter of volume resistivity $10^8$–$10^9$ $\Omega$·cm and arranged between the drive roller 11 and the driven roller 12 with a prescribed tension given.

Further, in the embodiment explained below, a rubber belt made of semiconductive rubber having volume resistance $10^9$ $\Omega$·cm used as a base material and coated by the surface layer of large resistance in a thickness of 3.0–10.0 $\mu$m is used. To reduce the frictional resistance of the belt surface, the upper layer of the surface layer is coated by a lubricant comprising fluorine/silicon resin in 3.0–5.0 $\mu$m.

The power applying roller 13 is formed with a conductive elastic roller having volume resistance $10^2$–$10^8$ $\Omega$·cm and transfer bias is applied from the transfer bias power device 15. Further, in this embodiment, the power applying roller 13 is made using conductive urethane rubber formed by foamed material having volume resistance $10^5$ Ω·cm and rubber hardness on the roller 30° C. of the Asker C durometer. As a matter of course, ethylene rubber EPDM, silicon, etc. are usable for the power applying roller 13.

Figure 2:
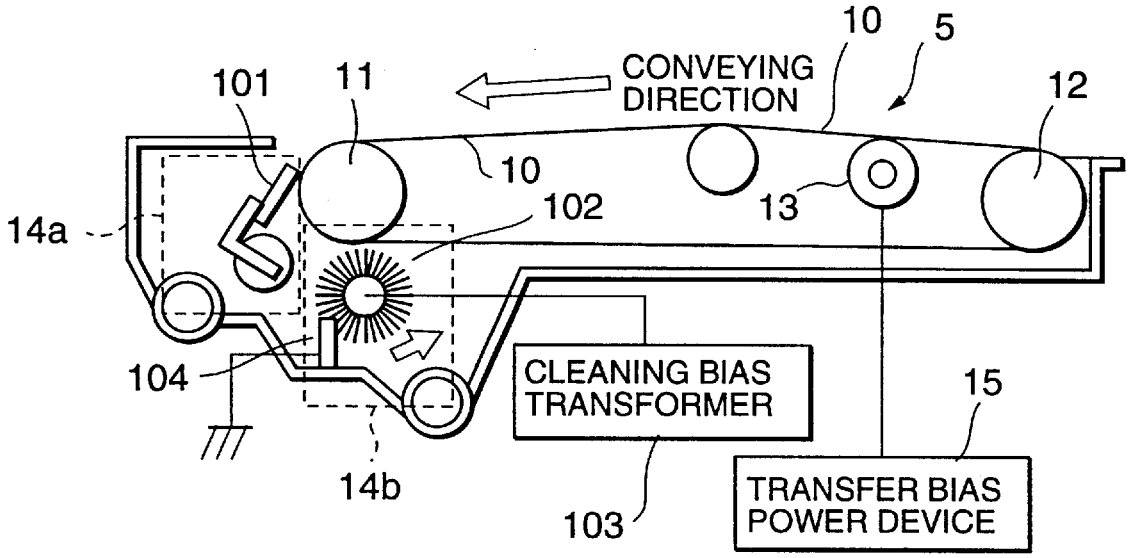
FIG. 2 is a schematic diagram showing the structure of a belt cleaner that is applied to the transferring device shown in FIG. 1.

The belt cleaner 14 comprises a first cleaner 14*a* and a second cleaner 14*b*, which can be brought in contact with/separated from the transferring belt 10, respectively as shown in FIG. 2. The first cleaner 14*a* is positioned at the upper stream side of the rotating direction of the transferring belt 10 shown in FIG. 2 and the second cleaner 14*b* are positioned at the downstream side of the same.

The first cleaner 14*a* is of blade cleaning type using a plate-shape rubber arranged so as to contact the transferring belt 10 at a prescribed angle. This first cleaner 14*a* is brought in contact with the transferring belt 10 at a prescribed amount of thrust and scrapes away toner, paper dust, fiber pieces, etc. adhered on the transferring belt 10.

A cleaning blade 101 is made of a plate-shape rubber bonded to a sheet metal. Rubber hardness in the range of 50°–70° of JIS-A durometer is desirable and contacting pressure to the transferring belt 10 in the range of line pressure 1.0 g/mm–3.0 g/mm is desirable.

In this embodiment explained below, a 2.0 mm thick urethane rubber of JIS-A hardness 68° with Young's modulus 59,000 g/cm$^2$ is used and is set so as to press a rubber blade in free end 6.0 mm against the transferring belt at the line pressure 1.8 g/mm.

Further, the cleaning blade 101 is in such structure that it is separated from/brought in contact with the transferring belt 10 by a solenoid (not shown).

The second cleaner 14*b* is of brush cleaning type using a cleaning brush 102 arranged rotatably so as to contact the transferring belt 10 at a prescribed amount of thrust.

Figure 3:
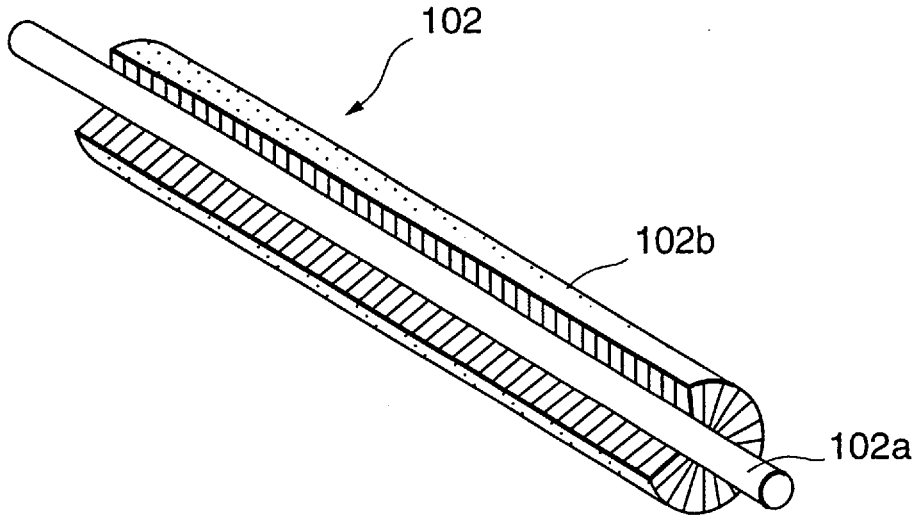
FIG. 3 is a schematic diagram showing the structure of a cleaning brush of the belt cleaner shown in FIG. 2.

The cleaning brush 102 has many fibers 102*b* extending radially on a metallic shaft 102*a* of such as SUS centering around the shaft as shown in FIG. 3. The fiber 102*b* is desirable to have conductivity of about $10^7$–$10^9$Ω and thickness within a range of 6.0–9.6 denier. In this embodiment, the cleaning brush 102 processed to have a conductive polyester brush of resistance $10^9$Ω and thickness 9.6 denier planed at a density 50,000 pieces/inch$^2$ is used.

The outer diameter of the cleaning brush 102 is ϕ18.4 mm and length of each brush fiber is 5.2 mm. Further, the diameter of the shaft 102*a* is ϕ8 mm. The cleaning brush 102 is set to have an amount of thrust 1.0–1.5 mm to the transferring belt 10 at the contact position for the drive roller 11 and rotates in the reverse direction against the rotating direction of the transferring belt 10. In this embodiment, the number of revolutions of the cleaning brush 102 is 262 mm/sec.

Cleaning bias current is applied to the shaft of the cleaning brush 102 from a cleaning bias transformer 103. Cleaning bias is selectable as desired according to constant current/constant voltage system, resistance of the cleaning brush 102 and the transferring belt 10, process speed, etc. In this embodiment, from the viewpoint of priority of the cleaning capacity of the transferring belt 10, the constant current system is used and applying current is 5.0 μA.

Around the cleaning brush 102, there are provided a metallic flicker bar 104 electrically grounded to flick toner adhered to the cleaning brush 102. The flicker bar 104 is arranged to thrust to the cleaning brush 102 by about 1.0–1.2 mm and the fibers are beaten by the rotation of the cleaning brush 102.

At the downstream side of the transferring device 5, a fixing device 8 is arranged to fix a toner image on an image receiving medium transferred from the photosensitive drum 1 by the transferring device 5 by fusing under a prescribed heat and pressure as shown in FIG. 1. This fixing device 8 comprises a pair of fixing rollers 8A and 8B that are kept in contact with each other under a prescribed pressure.

Next, the operation of the printer will be explained referring to FIG. 1.

First, when the power switch (not shown) is turned ON, the warm-up of the printer starts.

That is, a heater (not shown) of the fixing device 8 is energized and a pair of fixing rollers 8A and 8B of the fixing device 8 are heated to a prescribed surface temperature. In succession, a main motor (not shown) to turn the photosensitive drum 1 is rotated and the photosensitive drum 1 is rotated at a prescribed speed. In this embodiment, the rotating speed of the photosensitive drum is 400 mm/sec.

At this time, a prescribed voltage, that is, surface potential is applied to the surface of the photosensitive drum 1 by the main charger 2. At the same time, prescribed bias voltage is applied to a developer (not shown) in the developing roller 4A of the developing device 4 and the housing, and the developing roller 4*a* is rotated at a prescribed speed. In this embodiment, developing bias voltage is −400 V.

Further, the charge eliminator 7, which radiates prescribed wavelength light, is turned ON and the surface potential of the photosensitive drum 1 is stabilized, that is, aged. When the surface potential of the photosensitive drum 1 is stabilized and the fixing device 8 reaches a prescribed temperature by this warm-up process, it becomes possible to input an instruction to start the printing from an external device (not shown).

When it is instructed to start the recording from an external device (not shown) and the transfer of printing data is approved by the CPU 20 at a prescribed timing, printing data are transferred to the buffer memory 23 from the external device (not shown). The printing data taken into the buffer memory 23 is applied with a prescribed image process in the RAM 22.

The CPU 20 converts this printing data into image data corresponding to a pattern of intensity of laser beam to be output from a semiconductive laser device (not shown) of the exposure device 3 and supplies this image data to the printing image signal generating circuit 31.

The printing image signal generating circuit 31 changes intensity of the laser beam emitted from the semiconductive laser device (not shown) of the exposure device 3 corresponding to the image data so that electric charge of the photosensitive drum 1 charged in advance to a prescribed surface potential is changed to a level that can be selectively attenuated.

Thus, the laser beam emitted from the exposure device 3 is reflected on an exposure mirror and guided to a prescribed position on the outer circumference of the photosensitive drum 10.

The photosensitive drum 1 is charged to a prescribed surface potential by the main charger 3 before the laser beam of which intensity is changed corresponding to image data is applied. In this embodiment, the surface potential is −600V. On the photosensitive drum 1, the surface potential is selectively attenuated corresponding to supplied image data and an electrostatic latent image corresponding to image data is formed.

The electrostatic latent image formed on the outer circumference of the photosensitive drum 1 is developed with a toner supplied from the developing device 4 and visualized as a toner image. This toner image is transferred by the transferring device 5 onto an image receiving medium supplied from a paper cassette or a manual paper feeder (not shown) by electrostatically adsorbed by the transferring belt 10.

The transferring device 5 is brought in contact with the photosensitive drum 1 after the elapse of a fixed time from starting the development by a solenoid (not shown) and starts the transfer of a toner image as the transfer bias current supplied from the transfer bias power device 15 is applied.

The toner image transferred on an image receiving medium by the transferring device 5 is separated from the photosensitive drum 1 together with the image receiving medium that is electrostatically adsorbed by the transferring belt 10 and conveyed toward the fixing device 8 in that state. Then, the image receiving medium is separated from the transferring belt 10 at its end and led between a pair of fixing roller 8A and 8B of the fixing device 8.

The toner image led to the fixing device 8 is fused under the heat and pressure from the fixing roller pair 8A and 8B and fixed on the image receiving medium. Then, this image receiving medium is ejected to the outside of the printer.

On the other hand, after transferring a toner image on an image receiving medium, the photosensitive drum 1 is cleaned by the photosensitive drum cleaner 6 to remove residual toner left on the surface and the charge is eliminated by the charge eliminator 7 and used for next image forming. When the image forming process is continuously performed two times or more, a series of the above-mentioned operation is repeated for required number of times.

Further, a corona charging type by discharge from a wire, a charging roller type using an elastic roller or a brush charging type using a conductive brush is generally used for the main charger 2.

Further, for the developing device 4, a two-component type using a developer that is a mixture of carrier and toner, a single component type using toner only, a contact type contacting the photosensitive drum 1, a non-contact type that does not contact the photosensitive drum 1 or a liquid type containing toner particles dispersed in liquid is generally used.

By the way, for the cleaning of the transferring belt 10, a blade cleaning type using a rubber blade is generally adopted. The blade cleaning type is generally used as it is simple in structure and cheap in cost. However, when trying to achieve the long life of this blade cleaning type, there is such a problem that the cleaning blade itself is worn out by the friction with paper dust generated from an image receiving medium and with the transferring belt and a defective cleaning may result.

To solve the above-mentioned problem, a method has been proposed to prevent the defective cleaning by increasing a contacting angle of the cleaning blade 101 with the transferring belt 10 and supply toner onto the transferring belt 10 while controlling amount of toner corresponding to the progress of abrasion of the blade in order to prevent defective cleaning after supplying 100,000 sheets of paper and the blade curling in the initial state. According to this system, it is possible to suppress amount of supplying toner relatively less and also possible to prevent generation of the defective cleaning.

However, according to the above system, an effect could be observed when image receiving media were continuously supplied but, in a mode that is close to the normally using state, for instance, in the 5 sheets intermittent paper supply mode, the defective cleaning may be generated after supplying 100,000 sheets of paper.

So, a cause for generating the defective cleaning was investigated.

Figures 4, 5, 6:
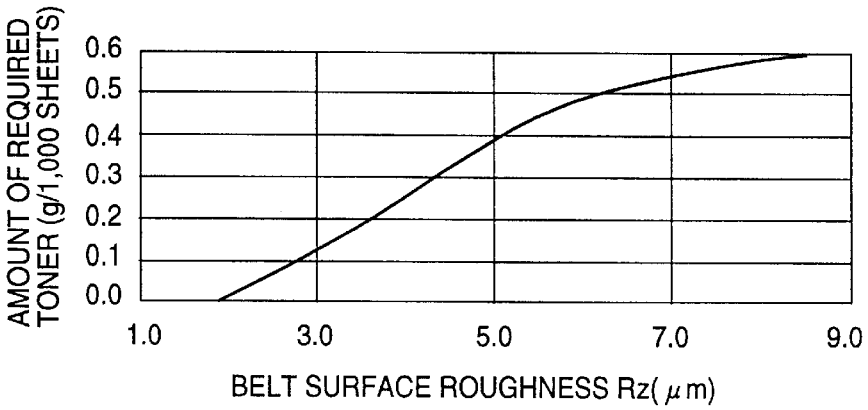
FIG. 4 is a table showing the results of observation of a transferring belt and a cleaning blade after supplying a sheet of paper.
FIG. 5 is a table comparing number of starts and stops in the continuous paper supply and intermittent paper supply.
FIG. 6 is a graph showing the relationship between the surface roughness of a transfer belt and amount of toner required for preventing edge chip.

FIG. 4 is a diagram showing the result of observation conducted on the transferring belt 10 and the cleaning blade 101 after the continuous paper supply and intermittent paper supply. Further, in the case of continuous paper supplying, values converted into the continuous paper supplying were calculated and used.

From the result shown in FIG. 4, the minimum value of the surface roughness of the transferring belt 10 used for the continuous paper supplying is 3.0 $\mu$m and the maximum value is 3.5 $\mu$m and almost uniform surface roughness was obtained. Further, the edge chip of the cleaning blade 101 was not especially observed at the rear, center and front portions of the cleaning blade 101 and the abrasion state of the cleaning blade 101 was almost uniform.

On the contrary, the minimum value of the surface roughness of the transferring belt 10 used for the intermittent paper supplying was 3.0 $\mu$m and the maximum value was 6.0 $\mu$m, more worse than the transferring belt used in the continuous paper supplying and very large roughness was observed locally. Further, a very large flaw was produced on the edge of the cleaning blade 101 and moreover, a chip was produced near the central and front portions, that is, it was confirmed that the defective cleaning was caused by the local surface roughness of the transferring belt 10 and the flaw on the edges of the cleaning blade 101.

Further, in this embodiment, the surface roughness expressed here is the 10 point mean roughness (Rz) shown in JIS-B-0601 and the reference length is according to the JIS standard.

So, causes for generating this flaw were checked from different conditions of the continuous paper supplying and the intermittent paper supplying. Here, it was perceived that the rotating time of the transferring belt 10 while the cleaning blade 101 is kept contact with the transferring belt 10 without toner was very long in the intermittent paper supplying.

FIG. 5 is a comparison of the number of starts and stops per 1,000 sheets of paper in the continuous paper supplying and the intermittent paper supplying. Here, the continuous paper supplying is a case where 1,000 sheets of paper are supplied at one time of starting and an image is formed on each of them. The intermittent paper supplying is a case where 50 sheets of paper are continuously supplied at one time of starting and after forming an image on each of the paper, the operation is once stopped and 50 sheets of paper are supplied again continuously and this operation is repeated 20 times.

In the case of the continuous paper supplying, toner is supplied onto the transferring belt 10 at intervals of paper supply and this toner serves as a lubricant and therefore, a chance for the transferring belt 10 to directly contact the cleaning blade 101 is very less.

On the contrary, in the case of the intermittent paper supplying, as the transferring belt 10 is separated from the photosensitive drum 1 and rotates when starting and stopping the printer, the cleaning blade 101 contacts the transferring belt 10 without toner. In the test shown in FIG. 5, in the case of the intermittent paper supplying, a difference between the number of starts and stops was as many as 19 times and a total time of the transferring belt 10 kept in contact with the cleaning blade 101 is extremely long.

Therefore, the surface roughness of the transferring belt 10 becomes worse and a large scale of roughness is locally generated.

Next, cases for generating flaws on the edge portion of the cleaning blade 101 causing the defective cleaning was checked.

From the result of observation shown above, by changing the surface roughness of the transferring belt 10, the transferring belt 10 was rotated by bringing the cleaning blade 101 in contact with the transferring belt 10 directly and the test was conducted to check an influence given to the edge of the cleaning blade 101. Further, a precision abrasive manufactured by Sumitomo 3M was used for polishing the surface of the transferring belt 10.

From the result of this test, it was revealed that the more the surface roughness is large, the less a time for generating the chip of edge becomes short. In other words, when the transferring belt 10 is rotated in the state of the rough surface by contacting the cleaning blade 101 directly to the transferring belt 10, a large stress is applied to the cleaning blade 101. Therefore, it was confirmed that the above-mentioned control method rather gives a converse effect.

FIG. 6 shows the relationship between the surface roughness (Rz) of the transferring belt 10 and amount of toner needed for preventing generation of chips of the edge portion of the cleaning blade 101. Further, a required amount of toner uses an amount (g) of toner needed for 1,0000 sheets of paper.

From the result shown in FIG. 6, it is seen that with the increase of the surface roughness, an amount of toner needed to prevent the edge chip increases. That is, the coefficient of friction for the cleaning blade 101 becomes high with the increase of the surface roughness and much amount of toner as a lubricant is needed, accordingly.

So, a method is considered to supply toner required at the time of the life end from the initial stage to the transferring belt 10 for use as a lubricant between the transferring belt 10 and the cleaning blade 101. However, when toner is supplied to the transferring belt 10 for the purpose of lubrication from the initial stage, amount of toner to be scraped away by the cleaning blade 101 increases and there is a problem that toner consumption increases.

So, the printer shown in this embodiment is so constructed that toner is not supplied at the initial stage and a supply amount of toner is adjusted according to a running distance of the transferring belt 10. That is, as a lubricant comprising fluorine/silicon resin is coated on the surface of the transferring belt 10 at the initial stage, the coefficient of friction is not so high as requiring lubricant separately.

On the contrary, when the running distance of the transferring belt 10 increases, its surface roughness increases gradually and therefore, the supply amount of toner onto the transferring belt 10 is so control as to increase gradually corresponding to the running distance.

Here, the image forming process to supply toner to the transferring belt 10 will be described. As described above, in order to adjust toner supply amount corresponding to the running distance of the transferring belt 10, the following systems are considered:

(1) Adjust amount of toner adhered to an image by changing an exposure pattern from the exposure device 3 after charging the photosensitive drum 1 by the main charger 2;

(2) Adjust amount of toner adhered by changing the surface potential of the photosensitive drum 1 by changing voltage applied to the grid (not shown) of the main charger; and (3) Adjust amount of toner adhered to an image by changing developing bias voltage to be applied to the developing device 4.

In (1) of these systems, extra fatigue is added to the photosensitive drum 1 and when this fatigue is accumulated as a history, the life of the photosensitive drum 1 is affected and therefore, the systems (2) and (3) become dominant.

Further, when the systems (2) and (3) are compared, in the system (2), a control is often used to change voltage to be applied to the grid according to the running distance of the photosensitive drum 1 or actually measure the surface potential of the photosensitive drum 1 and feed back the measured result to the voltage to be applied to the grid to cover the effect of the life fatigue of the photosensitive drum 1, that is, drop in the charging capacity, and when a control to change voltage is additionally incorporated, the control itself becomes extremely complicate.

Therefore, it can be seen that use of the system (3) to adhere a toner on the photosensitive drum 1 by changing developing bias voltage is the best system. Further, the printer in this embodiment uses the system to change voltage to be applied to the grid by measuring the surface potential of the photosensitive drum 1 and feeding back the measured result.

Figure 7:
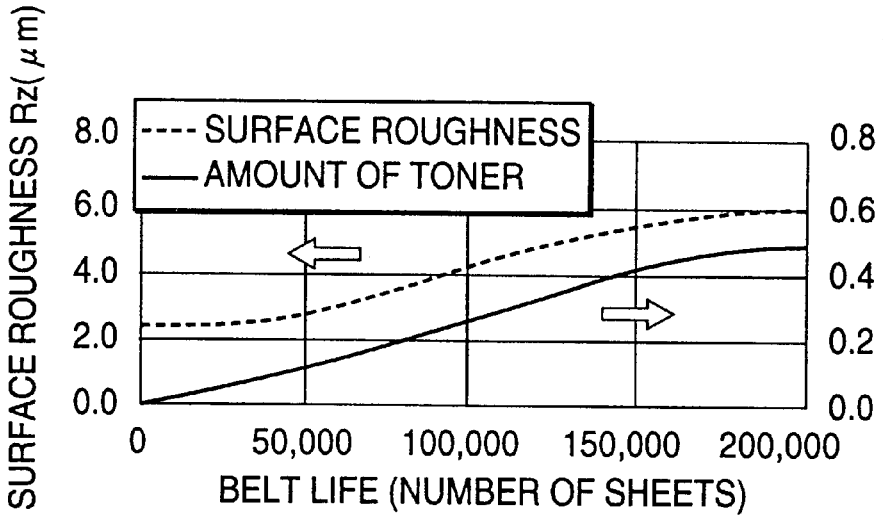
FIG. 7 is a graph showing cleaning property evaluation results.

FIG. 7 shows the evaluation result of the cleaning property using a toner amount supplied onto the transferring belt 10 for line copy, belt life and surface roughness as parameters. The paper supplying was made in the intermittent mode wherein 5 sheets of paper are supplied and printed continuously and stopped for one minute. In The cleaning property was judged according to amount of toner adhered to a tape that was pasted to the conveying surface of the transferring belt 10 and then, stripped off and presence of stain of the backs of sheets when A3 size paper (80 g/m$^2$) was supplied.

From the results shown in FIG. 7, the surface roughness of the transferring belt at the initial stage is very smooth and therefore, supply of toner is not required. Further, it was revealed that after 100,000 sheets of paper were supplied, 0.25 g of toner was needed and after 200,000 sheets were supplied, 0.5 g toner was needed . That is, as shown in FIG. 7, an amount of toner to be supplied to the transferring belt varies following the secular change of the surface roughness of the transferring belt 10 and the cleaning property can be maintained at a constant level by increasing an amount of toner to be supplied to the transferring belt 10 with the increase of the running distance of the transferring belt 10.

However, when the number of sheets exceeded 200,000, the cleaning property was not improved even when the supply quantity of toner to the transferring belt 10 was increased and the defective cleaning was generated.

So, the surface roughness of the transferring belt 10 and the edge portion of the cleaning blade 101 after supplying 400,000 sheets of paper were observed. No chip was recognized on the edge portion of the cleaning blade 101 but it was detected that the surface roughness of the transferring belt 10 became worse. From this result, the setting of the long life of more than 200,000 sheets is considered difficult only by the cleaning blade 101 and addition of a new mechanism is necessary.

So, the transferring device 5 is equipped with a brush cleaning system to perform the cleaning by the electric field using a conductive brush as a belt cleaner 14 of the transferring belt 10 in addition to the blade cleaning system.

When the brush cleaning system is used as a transferring belt 10 cleaner, mechanical stress to the transferring belt is less, fibers thrust into the belt surface and there is such a merit that the defective cleaning is hardly generated even when the surface of the transferring belt becomes rough.

Figure 8:
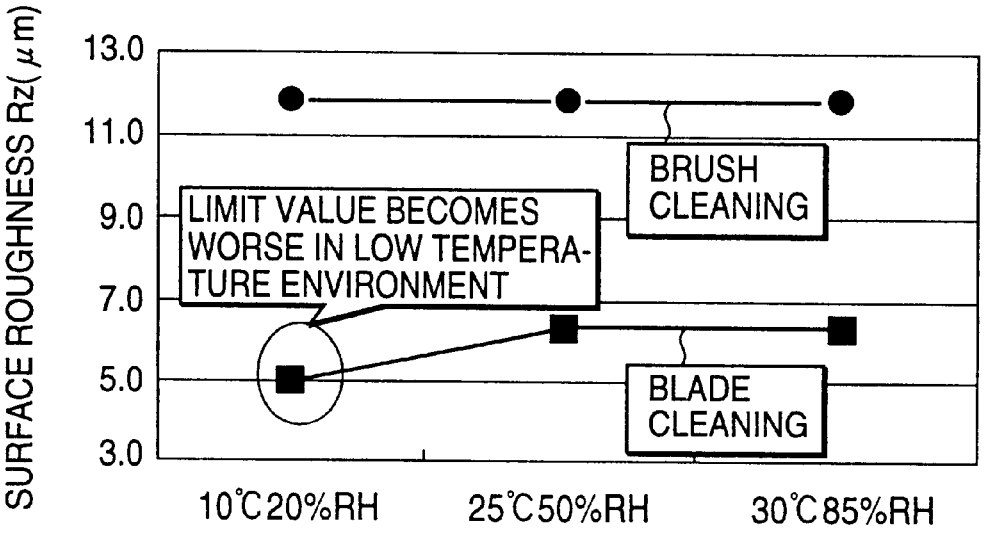
FIG. 8 is a graph showing the surface roughness of a transfer belt and improper cleaning generating limit.

FIG. 8 shows the result of investigation conducted on the limits of generating defective cleaning by the cleaning blade 101 and the cleaning brush 102 to the surface roughness (Rz) of the transferring belt 10. From this result, the brush cleaning system obtained a good cleaning roughness in the using environments at low temperature and low humidity (10° C., 20% RH), normal temperature and normal humidity (25° C., 50% RH) and high temperature and high humidity (30° C., 85% RH).

On the contrary, it was revealed that the blade cleaning system is capable of maintaining good cleaning property for the transferring belt of which surface roughness is about half of that of the brush cleaning system in the using environments at low temperature and low humidity (10° C., 20% RH), normal temperature and normal humidity (25° C., 50% RH) and high temperature and high humidity (30° C., 85% RH).

Furthermore, it was revealed that in the case of the blade cleaning system, the surface roughness of a transferring belt that can be processed in the using environment of low temperature and low humidity drops extremely.

Thus, when the blade cleaning system and the brush cleaning system are compared, it can be seen that the brush cleaning system is dominant.

However, if a large amount of toner was supplied to the transferring belt in the case of defective paper supply, that is, a so-called jam was generated in a printer, the surface of the transferring belt cannot be cleaned sufficiently by one time cleaning with a cleaning brush only.

Figure 9A:
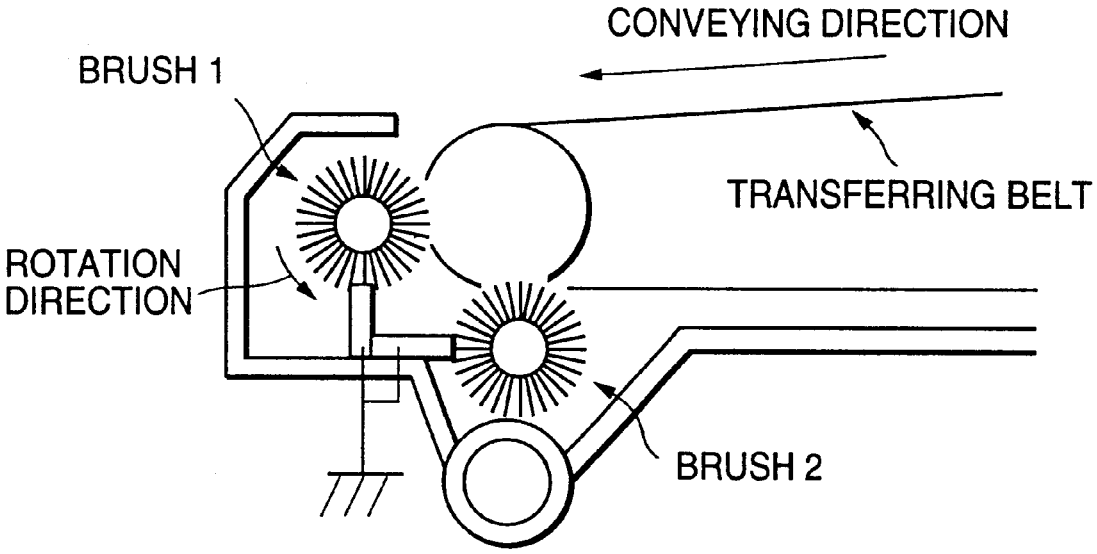
FIGS. 9A and 9B are schematic diagrams showing belt cleaners in other structure.
Figure 9B:
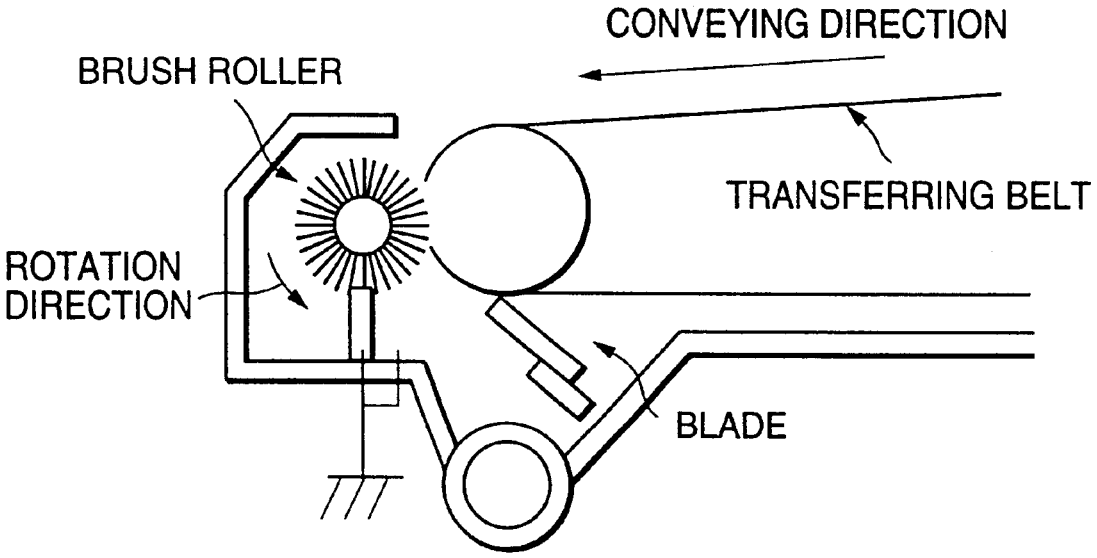

So, a cleaner having a cleaning brush arranged at two stages (hereinafter, referred to as a two-stage brush cleaner) as shown in FIG. 9A and a cleaner having a cleaning brush arranged at the upper stream side and a cleaning blade arranged at the downstream side (hereinafter, referred to as a brush +blade cleaner) as shown in FIG. 9B were examined.

FIG. 10 is a table showing the result of check made on presence of defective cleaning generated when a life test was conducted with the above-mentioned cleaners installed to the printer. Further, this life test was conducted in the state that is close to a normal use, that is, in the 5 sheets intermittent supply mode.

Further, in order to prevent the stain of the cleaning brush by toner, a system to supply toner onto the transferring belt 10 as a lubricant as mentioned above is not used in these cleaners (no lubricant is required for the two-stage brush cleaner).

On both cleaners, no stain was generated on the back of an image receiving medium up to 200,000 sheets. However, after 250,000 sheets, the stain began to be generated a little on the back and after 300,000 sheets, the remarkable back stain was generated.

So, by suspending the life test at 300,000 sheets, a cause for generating the back stain was checked and it was found that toner that was removed by the cleaning brush was again adhered to the transferring belt.

In the two-stage brush cleaner, the cleaning brush at the upper stream side in the rotating direction of the transferring belt 10 was stained excessively and a large amount of toner was again adhered to the transferring belt 10, and it was revealed that by this toner, the cleaning brush at the downstream side was also stained, resulting in the drop of the cleaning property. Further, in the brush +blade cleaner, the toner adhered to the transferring belt 10 again could not be cleaned completely by the cleaning blade and the back stain was generated.

Next, a cause for re-adherence of toner from the cleaning brush was investigated. On an unused cleaning brush that is equivalent to the initial state, voltage at applying current 5.0 $\mu$A is about 300–500 V. On the contrary, on a cleaning brush after printing 300,000 sheets, voltage was increased to 1.0–2.0 kV. It was considered that this voltage level reaches the discharge starting region and the polarity of toner was changed to the +polarity by this discharge phenomenon and toner adhered again to the transferring belt 10.

When the cleaning brush after supplying 300,000 sheets of paper was cleaned and the cleaning property and voltage were measured again. The cleaning property was improved and voltage dropped to about 300V.

From these results, it was revealed that the adhesion of toner for a long period results in drop of the cleaning property and to obtain the stabilized cleaning property it is necessary to clean the brush at the stage where a certain level of life is reached. However, a cleaning margin is large for the change in the surface roughness of he transferring belt as mentioned above and it is therefore considered possible to retain the stabilized cleaning property for a long period of life by developing a transferring belt cleaner combined with a merit of the blade cleaning system mentioned above.

The belt cleaner 14 in this embodiment shown in FIG. 2 was made in view of the above result and is characterized in that up to the prescribed number of sheets of image receiving medium, the blade cleaning system shown by a first cleaner 14*a* is used and after reaching the prescribed number of sheets, use of the blade cleaning system is suspended and the brush cleaning system shown by a second cleaner 14*b* is used.

Further, in the blade cleaning system, a control to change amount of toner supplied to the transferring belt 10 as a lubricant according to the transferring belt life is jointly used. After a prescribed number of sheets were reached, the brush cleaning system is used up to the life end.

In this structure, it becomes possible to prevent the toner adherence to the cleaning brush 102 up to a prescribed number of sheets and also, prevent the drop of cleaning property. Further, a prescribed number of sheets of image receiving medium are here by converting into a running distance of the transferring belt.

An embodiment of a printer using the cleaner 14 shown in FIG. 2 is explained below.

FIG. 11 shows the classification of the cleaning system control and the developing bias control to the running distance of the transferring belt 10.

In the printer in this embodiment, the control of the cleaning system is classified into two sections; the blade cleaning system A as a first mode and the brush cleaning system B as a second mode. Further, the length for using the blade cleaning system is classified into 4 sections: (1) 10,500 m, (2) 21,000 m, (3) 31,500 m and (4) 42,000 m.

The cleaning system controls the use of the blade cleaning system A from the initial state till the running distance of the transferring belt 10 reaches 42,000m and the use of the brush cleaning system B from the running distance 42,000m to the life end.

That is, in the blade cleaning system A, the cleaning blade 101 is kept in contact with the transferring belt 10. In the brush cleaning system B, the cleaning blade 101 is separated from the transferring belt 10 and the cleaning brush 102 is brought in contact with the transferring belt 10.

In the blade cleaning system A, an amount of toner to be supplied to the transferring belt 10 is controlled to 0 g/1,000 sheets for the running distance of the transferring belt from the initial state to 10,500 m, 0.125 g/1,000 sheets for 21,000 m, 0.25 g/1,000 sheets for 31,500 m and 0.5 g/1,000 sheets for 42,000 m.

Further, in the brush cleaning system B, it is controlled not to supply toner onto the transferring belt 10.

In the blade cleaning system A, developing bias to be applied to the developing device 4 is controlled to −400 V by the developing bias power device 41 for the running distance of the transferring belt 10 from the initial state to 10,500 m. Developing bias at this time is the same as that in the normal use. Further, developing bias is controlled according to the running distance of the transferring belt 10; that is, −460 V up to 21,000 m, −520 V up to 31,500 m and −560 V up to 42,000 m, respectively.

Further, in the brush cleaning system B, developing bias is controlled to −400 V that is the same level at the normal used.

In the blade cleaning system A and the brush cleaning system B, developing bias voltage to be applied to the developing device 4 is controlled in respective classifications as described above.

Further, running distances of the transferring belt 10 are calculated by counting the number of revolutions of a motor (not shown) connected to the drive roller 11 that drives the transferring belt 10 in the CPU 20.

Conditions for respective classifications will be explained below.

Figure 12:
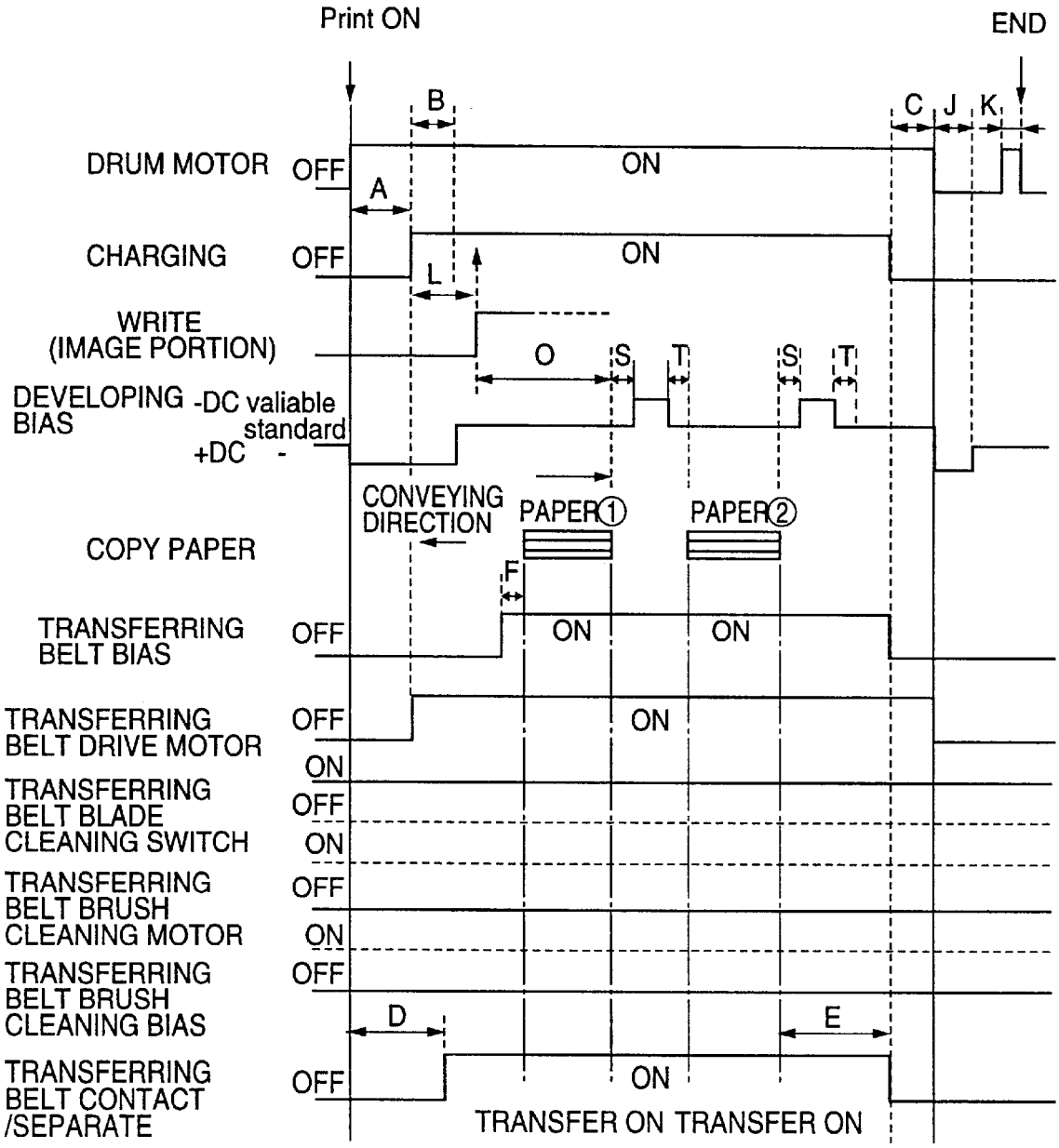
FIG. 12 is a timing chart showing the operation when using a cleaning blade.
Figure 13:
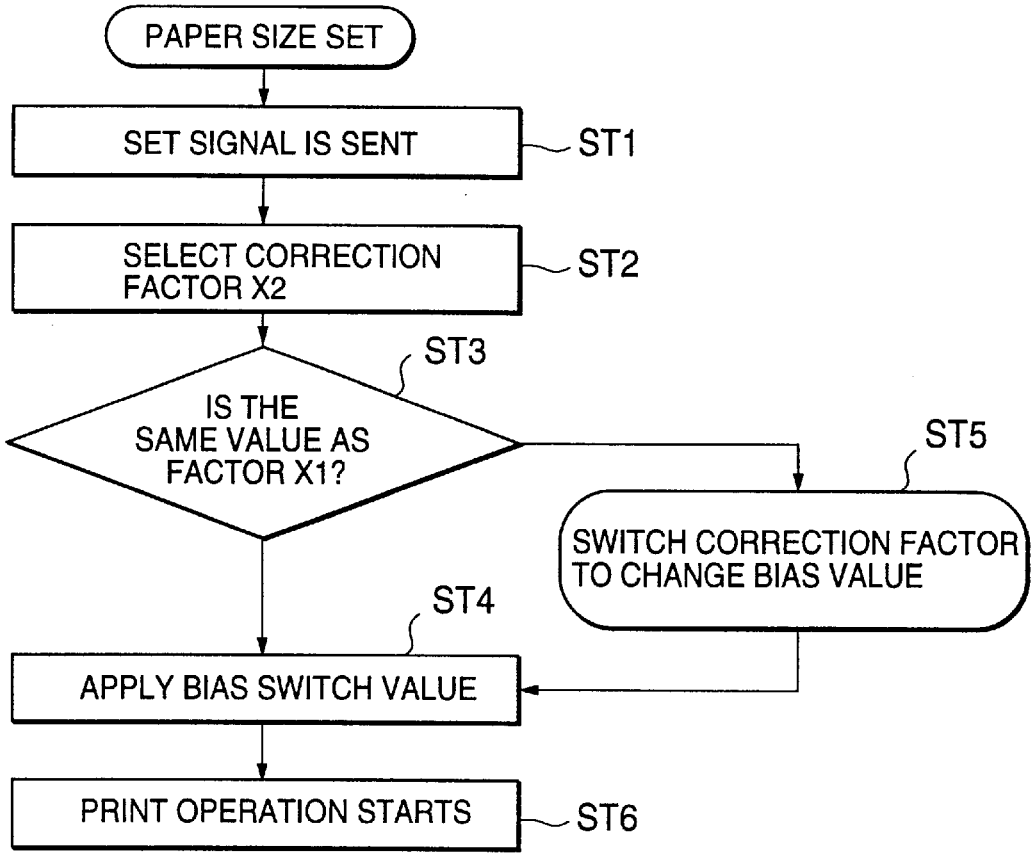
FIG. 13 is a flowchart showing a developing bias changing method according to paper size.

FIG. 12 is a chart showing the control timing of each classification when using the blade cleaning system shown by Classification A.

In the blade cleaning system shown by Classification A, a developing bias value is changed according to a running distance of the transferring belt 10 at the supply interval of image receiving medium and the end of print, and a prescribed amount of toner is supplied onto the transferring belt 10 as a lubricant.

That is, as the surface of the transferring belt 10 becomes rough depending on a running distance of the transferring belt 10 as described above, developing bias is changed to −560 V based on −400 V at the normal use at the interval of image receiving medium. Then, in the J period at the end of print, plus developing bias is applied. By such change of developing bias, an amount of toner supplied onto the transferring belt 10 as a lubricant is adjusted.

By supplying such developing bias, toner is supplied to the transferring belt 10 at the image receiving medium supply interval, that is, between sheets of paper and at the end of print as shown in FIG. 12.

Here, a method for switching developing bias at the image receiving medium supply interval will be explained.

When kinds of image receiving media, for instance, A4 size paper and A3 size paper are compared, a running distance of the transferring belt on A3 size paper is two times of a vertical A4 size paper. Therefore, when A3 size sheets of paper are printed continuously, an amount of toner supplied to the transferring belt 10 becomes half of that when A4 size sheets in the numbers are printed.

So, on a printer shown in this embodiment, developing bias is changed depending on paper size according to a method shown in the flowchart in FIG. 3.

When the outline of this process is explained, a signal corresponding to a paper size optionally selected by a printer or user is first sent to the CPU 20 in the printer (ST1). Then, the CPU 20 selects Correction Factor X2 corresponding to a paper size from the ROM 21 based on the paper size signal received (ST2).

Then, Correction Factor X1 of a developing bias switching value Vbv1 stored in the ROM 21 is compared with Correction Factor X2 (ST3). At this time, when Correction Factor X1 and Correction Factor X2 are the same value, a signal is sent to the developing bias generating power source and the developing bias switching value Vbv1 is applied (ST4).

Further, when Correction Factor X1 and Correction Factor X2 are different each other, correction factors are changed, the developing bias switching value Vbv2 is calculated and a changed value is set (ST5). Then, a signal is sent to the developing bias generating power source, the switch of the developing bias switching value is turned ON, a prescribed value is set and applied (ST6). For Correction Factor X, a value calculated based on the A4 lateral size is used.

Further, in the Classification A, transferring belt bias that is applied to the transferring belt 10 from the transfer bias power device 15 via the power applying roller 13 is turned ON at a prescribed level and a timing that has a margin of the F period (FIG. 12) from the leading edge of a first supplied paper and turned OFF at a timing that has a sufficient margin from the trailing edge of a lastly supplied paper.

Needless to say, in the Classification A, the transferring belt blade cleaning switch is kept always ON and the cleaning blade 101 is kept in contact with the transferring belt 10 at a prescribed line pressure.

Further, in the Classification A, the transferring belt brush cleaning motor is always kept OFF and the cleaning brush 102 is being rotated jointly with the transferring belt 10 while kept in contact with the transferring belt 10. At this time, the transferring belt brush cleaning bias is not applied.

In the Classification A, the blade cleaning system is used according to the method described above. However, when the running distance of the transferring belt 10 reaches a prescribed distance (that is, when the running distance reaches 42,000 m in this embodiment), the blade cleaning system is switched to the brush cleaning system.

Regarding the cleaning system switching conditions, the conditions are set based on the test result shown below in this embodiment.

Figure 14:
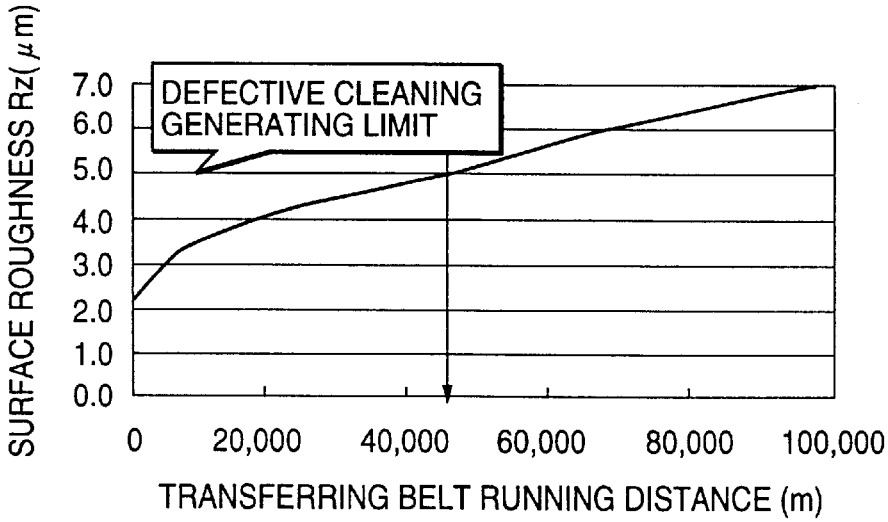
FIG. 14 is a graph showing change of surface roughness of a transferring belt and a cleaning limit.

That is, FIG. 14 shows the secular change of surface roughness of the transferring belt 10 when using the blade cleaning system and the limit value of the cleaning of the blade cleaning system. The limit of surface roughness to generate defective cleaning is 5.0 $\mu$m.

From this result, it can be seen that areas after the running distance 45,000 m become those areas that cannot be cleaned sufficiently by the blade cleaning and it becomes necessary to switch the cleaning system to the brush cleaning after 45,000 m.

In the printer shown in this embodiment, the cleaning system is changed at the running distance 42,000 m that is shorter than the running distance 45,000, a limit value, by 3,000 m. This is a margin at the runaway of the transferring belt 10. Further, when this margin is set, it becomes possible to switch the cleaning system after the end of print even when the cleaning system switching period is reached during the print and a loss time resulting from the switching is saved.

The method for switching the blade cleaning system (classification A) to the brush cleaning system (Classification B) will be explained below.

When the CPU 20 judges that the running distance of the transferring belt 10 reaches the switching distance that is stored in the ROM 21 (42,000 m in this embodiment) after the end of print or exceeds the switching distance after the end of print from the number of sheets to be printed and size set for the printer, the drive roller 11 that drives the transferring belt 10 stops after the end of print and the transferring device 5 including the transferring belt 10 is separated from the photosensitive drum 1 by a guide member (not shown). Thereafter, the cleaning blade 101 is separated from the transferring belt 10 by a solenoid (not shown) connected to a holder (not shown) supporting the cleaning blade 101 and kept in that state.

Then, the CPU 20 invalidates the switching of developing bias that is executed to supply toner to the transferring belt 10 at the supply interval of image receiving medium and at the end of print that are stored in the ROM 21 and also, regarding a timing to apply transfer bias current to the power applying roller 13 of the transferring device 5, gives an instruction to turn OFF the bias at the supply interval of image receiving medium and at the end of print.

Further, the CPU 20 gives an instruction to turn the brush cleaning power device ON and in the subsequent print, the blade cleaning system is switched to the brush cleaning system (Classification B).

Figure 15:
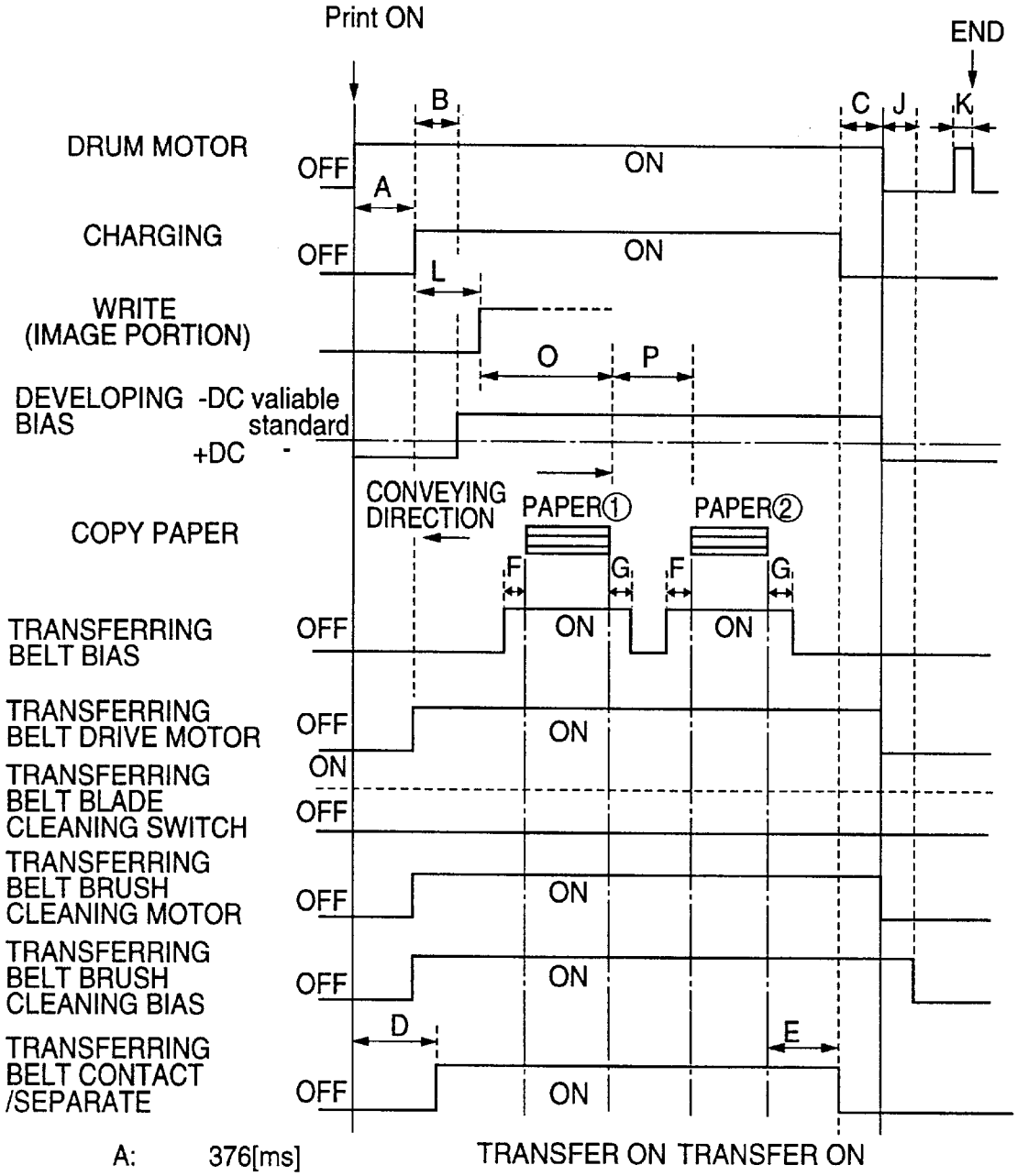
FIG. 15 is a timing chart showing the operation when using a cleaning brush.

The timing chart when the printer is used in Classification B in this embodiment is shown in FIG. 15. In Classification B, there are changes shown below when compared with Classification A shown in FIG. 12.

(a) At the image receiving medium supply interval, transfer bias current applied to the power applying roller 13 is turned OFF.

(b) At the image receiving medium supply interval, developing bias is not switched and fixed developing bias at the normal use only is applied.

(c) Transfer bias current is turned OFF before separating the transferring device 5 from the photosensitive drum 1 at the end of print.

(d) The transferring belt blade cleaning switch is always kept OFF.

(e) The transferring belt brush cleaning motor is turned ON/OFF synchronizing with the turning-ON/OFF of the transferring belt drive motor and the cleaning brush 102 is rotated in the direction reverse to the rotary direction of the transferring belt.

(f) The transferring belt brush bias is turned ON synchronizing with a timing to turn On the transferring belt drive motor and turned OFF at a margin of the J period from the transferring belt drive motor turn OFF timing.

These changes are devices planned to suppress the stain of the cleaning brush 102 mainly by toner as described above to the minimum. In Classification B, the print is executed without change of conditions to the life end.

The print test of 400,000 sheets in the 5 sheets intermittent mode was conducted by the above-mentioned controls and the back side stain of image receiving medium was checked, the generation of the back-side stain was not at all observed. Further, the evaluation method is the same as the above-mentioned method. From the result of this test, it was confirmed that the structure and control of the belt cleaner shown in this embodiment are extremely effective.

Further, after completing the paper supply test, an all over printed image was transferred by the transferring belt 10 and a taping test of residual toner left was conducted. As a result, although very little quantity of toner adhered was observed, the considerably far better improvement than the single cleaning blade 101 and the cleaning brush 102 was recognized.

Further, when voltage applied to the cleaning brush was measured, it was about 500–700V.

Figure 16:
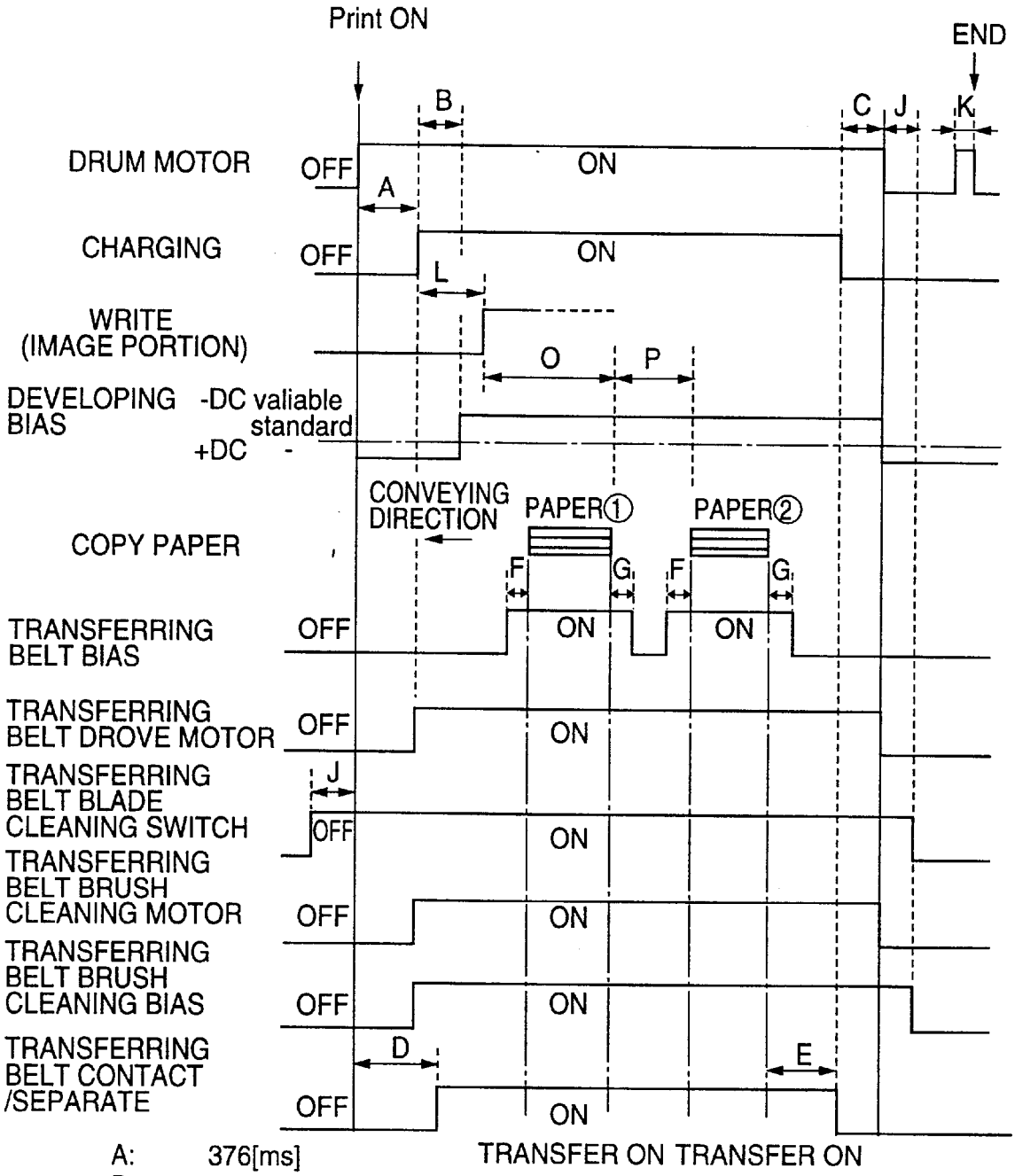
FIG. 16 is a timing chart showing the operation when using a cleaning brush in another embodiment.

FIG. 16 is a timing chart of a printer in other embodiment. In this embodiment, the blade cleaning system is jointly used when a certain condition is satisfied under the condition of Classification B wherein the brush cleaning system is used as shown in the timing chart.

That is, when a prescribed condition is satisfied under the condition of Classification B as shown in the timing chart in FIG. 16, the transferring belt blade cleaning switch is turned ON with the J period margin before starting the print and the cleaning blade 101 is brought in contact with the transferring belt 10 under a prescribed pressure by a solenoid (not shown). And the transferring belt blade cleaning switch is turned OFF with the J period margin from the timing to turn OFF the transferring belt brush cleaning motor.

The condition for bringing the cleaning blade 101 into contact again with the transferring belt 10 will be explained below.

(1) When a printer is placed in the humid using environment:

That is, under the humid environment, charged amount of toner generally drops and toner adhering to the background portion of the photosensitive drum 1, that is, fog goner increases. When A4 vertical size/A5 size sheets of paper are supplied at that time, toner at the portions to which no toner supplied is transferred directly to the transferring belt. The printer is in such structure that the blade cleaning system is used jointly with the brush cleaning system by bringing the cleaning blade 101 in contact with the transferring belt when the output of a humidity sensor that is set in a printer for preventing the stain of the cleaning brush from increasing exceeds a fixed value.

Figure 17:
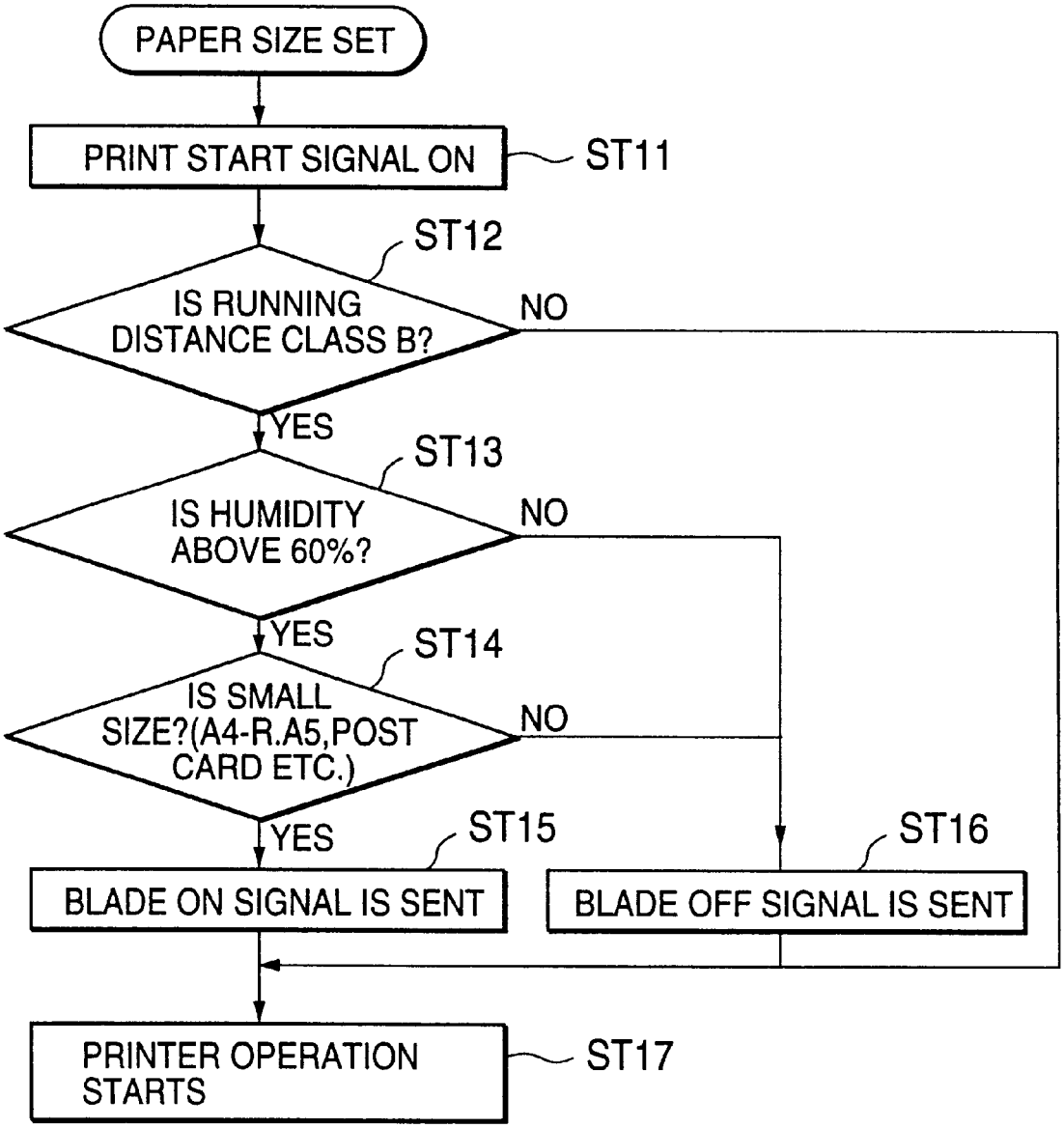
FIG. 17 is a flowchart showing the control by humidity in a printer in another embodiment.

In other words, as shown in the flowchart in FIG. 17, a signal corresponding to a paper size optionally selected by the printer or user is first sent to the CPU 20 in the printer. Then, a print start signal directing the print start is sent by user to the CPU 20 (ST11).

Then, the CPU 20 judges whether the running distance classification is Classification B of the blade cleaning system (ST12). When the running distance classification is judged to be Classification A of the blade cleaning system, the printer operation is started immediately (ST17). When the running distance classification is judged to be Classification B, the CPU 20 judges whether humid is 60% or above based on the output signal from the humidity sensor (ST13).

When the humidity is below 60%, an OFF signal is sent to the transferring belt blade cleaning switch (ST16). Thus, the cleaning blade is kept in the state separated from the transferring belt 10 in Classification B.

When the humidity is above 60%, the CPU 20 judges whether a paper size that is set is A4 vertical size/A5 size or a small size such as post card (ST14). When the set paper size was judged to be not a small size, an OFF signal is sent to the transferring belt blade cleaning switch (ST16). Thus, the cleaning blade is kept in the state separated from the transferring belt 10 in Classification B.

Further, when the set paper size is judged to be a small size, an ON signal is sent to the transferring belt blade cleaning switch (ST15). Thus, the cleaning blade is brought in contact with the transferring belt 10 and is used jointly with the cleaning brush in Classification B.

Then, the printer operation is started (ST17).

(2) During the reset operation after JAM:

That is, when an image receiving medium is jammed in the paper supply portion and the print operation is suspended, that is, when a JAM is generated, a part of a toner image formed on the photosensitive drum 1 may be transferred onto the transferring belt 10. In this case, likewise the above (1), the printer is set so as to bring the cleaning blade 101 in contact with the transferring belt 10 during the reset operation after JAM in order to prevent the stain of the cleaning brush from increasing by a toner image on the transferring belt 10.

In the above embodiment, a large amount of toner on the transferring belt 10 is removed by the cleaning blade 101 and residual toner that cannot be removed is removed by the cleaning brush 102. In this structure it is possible to a more long life belt cleaner 14 can be obtained.

Further, in this embodiment, the present invention is explained using a high-speed printer having a process speed as high as 400 mm/sec. and as a matter of course, this invention is also applicable to low and medium speed machines having a process speed of 100–200 mm/sec.

Further, in this embodiment, the invention is explained taking a printer using the electro-photographic process as an example of an image forming apparatus and this invention is possible to apply to magnetic printers, etc.

As explained above, by using a belt cleaning device and its control method according to this invention, it becomes possible to improve reliability higher than conventional cleaning system. Further, it is possible to make an image forming apparatus equipped with a transferring belt a long life device that was difficult to achieve by the conventional cleaning system.

As explained above, according to the present invention, it is possible to provide a transferring device equipped with a cleaner capable of maintaining reliability and stably cleaning a transferring belt when used for a long period and an image forming apparatus equipped with this transferring device.

What is claimed is:

1. A transferring device comprising:

transferring means for transferring a toner image on a photosensitive body onto an image receiving medium adsorbed electrostatically to a transferring belt and conveyed by the transferring belt;

a first cleaning means which is selectively contactable with the transferring belt for cleaning toner from the transferring belt when brought in contact with the transferring belt;

a second cleaning means which is selectively contactable with the transferring belt for cleaning toner from the transferring belt when brought in contact with the transferring belt, said second cleaning means being selectively contactable with the transferring belt at a position which is downstream, with respect to the direction of movement of the transferring belt, of a position at which the first cleaning means is brought in contact with the transferring belt;

first control means for controlling a switching of the first and second cleaning means between:

a first mode wherein the first cleaning means is brought into contact with the transferring belt at an initial stage of use wherein the running distance of the transferring belt is less than a prescribed value, and a second mode wherein, when the running distance of the transferring belt reaches the prescribed value, the first cleaning means is separated from the transferring belt and the second cleaning means is brought into contact with the transferring belt; and second control means for temporarily inducing both the first and second modes and temporarily causing the first and second cleaning means to both contact the transferring belt when a humidity of a transferring device operating environment exceeds a prescribed humidity or when the conveyance of image receiving medium becomes defective.

2. A transferring device as claimed in claim 1, wherein the first cleaning means includes a blade and the second cleaning means includes a brush.

3. A transferring device as claimed in claim 1, further comprising:

transferring bias applying means for always applying a prescribed transferring bias to the transferring belt in the first mode when the toner image is continuously transferred onto a plurality of image receiving media and applying the prescribed transferring bias to the transferring belt at a timing when the image receiving media pass through the transferring position in the second mode.

4. An image forming apparatus comprising:

developing means for supplying toner and developing an electrostatic latent image formed on a photosensitive body;

a transferring belt configured to electrostatically adsorb an image receiving medium and convey the image receiving medium in one direction;

transferring means for transferring a toner image on the photosensitive body developed by the developing means, onto the image receiving medium electrostatically adsorbed to the transferring belt;

a cleaning blade arranged to clean toner from the transferring belt when selectively brought in contact with the transferring belt;

a cleaning brush selectively contactable with the transferring belt at a position downstream, with respect to the direction of movement of the transferring belt, of the position at which the cleaning blade is contactable with the transferring belt;

first control means for controlling a switching between:

a first mode wherein the cleaning blade is brought into contact with the transferring belt at an initial stage wherein the running distance of the transferring belt is below a prescribed value, and a second mode wherein the cleaning blade is separated from the transferring belt and the cleaning brush is brought into contact with the transferring belt when the running distance of the transferring belt reaches the prescribed value; and second control means for temporarily inducing the cleaning blade and the cleaning brush to both contact the transferring belt when a humidity of an operating environment about the image forming apparatus exceeds a prescribed humidity or the conveyance of image receiving medium becomes defective.

5. An image forming apparatus comprising:

developing means for supplying toner and developing an electrostatic latent image formed on a photosensitive body;

a transferring belt configured to electrostatically adsorb an image receiving medium and convey the image receiving medium in one direction;

transferring means for transferring a toner image on the photosensitive body developed by the developing means onto the image receiving medium electrostatically adsorbed to the transferring belt;

a cleaning blade arranged to selectively contact the transferring belt and clean toner therefrom;

a cleaning brush arranged so selectively contact the transferring belt at a location downstream with respect to the conveying direction of the transferring belt of the position at which the cleaning blade contacts the transferring belt;

first control means for controlling a switching of the first and second cleaning means between:

a first mode wherein the first cleaning means is brought into contact with the transferring belt at an initial stage of use wherein the running distance of the transferring belt is less than a prescribed value, and a second mode wherein, when the running distance of the transferring belt reaches the prescribed value, the first cleaning means is separated from the transferring belt and the second cleaning means is brought into contact with the transferring belt; and developing bias applying means for applying a prescribed developing bias; corresponding to the running distance of the transferring belt to the developing means at a timing not to form the toner image and supplying a prescribed amount of the toner onto the transferring belt in the first mode and for suspending the supply of the toner onto the transferring belt without applying the prescribed developing bias to the developing means at a timing not to form the toner image in the second mode.

6. A transferring device comprising:

a transferring belt configured to electrostatically adsorb an image receiving medium and convey the mage receiving medium in one direction;

transferring means for transferring a toner image on a photosensitive body onto the image receiver medium adsorbed electrostatically to the transferring belt at a transferring position;

a cleaning blade arranged so as to be able to contact/separate with/from the transferring belt and clean toner on the transferring belt when brought in contact with the transferring belt;

a cleaning brush arranged so as to be able to contact/separate with/from the transferring belt at the downstream side in the conveying direction and clean the toner on the transferring belt when brought in contact with the transferring belt lower than the cleaning blade;

first control means for controlling a switching the first and second cleaning means between:

a first mode wherein the first cleaning means is brought into contact with the transferring belt at an initial stage of use wherein the running distance of the transferring belt is less than a prescribed value, and a second mode wherein, when the running distance of the transferring belt reaches the prescribed value, the first cleaning means is separated from the transferring belt and the second cleaning means is brought into contact with the transferring belt; and second control means for temporarily inducing both the first and second modes and causing the first and second cleaning means to both contact the transferring belt when a humidity of an operating environment exceeds a prescribed humidity or when the conveyance of image receiving medium becomes defective.

7. A transferring device as claimed in claim 6, further comprising:

transferring bias applying means for always applying a prescribed transferring bias to the transferring belt in the first mode when the toner image is continuously transferring onto a plurality of image receiving media and applying the prescribed transferring bias to the transferring belt at a timing when the image receiving media pass through the transferring position in the second mode.

8. A transferring device comprising:

a transferring belt configured to electrostatically adsorb an image receiving medium and convey the image receiving medium in one direction;

transferring means for transferring a toner image on a photosensitive body onto the image receiving medium adsorbed electrostatically to the transferring belt at a transferring position;

a cleaning blade arranged so as to be able to contact/separate with/from the transferring belt and clean toner on the transferring belt when brought in contact with the transferring belt at an upstream position with regard to the moving of the transferring belt;

a cleaning brush arranged so as to be able to contact/separate with/from the transferring belt at a downstream position lower than the cleaning blade to clean the toner on the transferring belt when brought in contact with the transferring belt;

cleaning bias applying means for applying a prescribed cleaning bias to the cleaning brush; and control means for controlling a switching between a first mode to bring the cleaning blade in contact with the transferring belt at an initial stage of belt use wherein the running distance of the transferring belt is less than a prescribed value, and a second mode to separate the cleaning blade from the transferring belt and bring the cleaning brush in contact with the transferring belt when the running distance of the transferring belt reaches the prescribed value.

9. A transferring device as claimed in claim 8, further comprising:

second control means for controlling in the second mode so as to use the first mode jointly temporarily with the second mode when a using environment exceed a prescribed humidity or the conveyance of image receiving medium becomes defective.

* * * * *